US011624294B1

(12) United States Patent
Moffett

(10) Patent No.: US 11,624,294 B1
(45) Date of Patent: Apr. 11, 2023

(54) RESTRAINING PLUG

(71) Applicant: Raytheon Technologies Corporation, Farmington, CT (US)

(72) Inventor: Utah Moffett, Middletown, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 17/557,844

(22) Filed: Dec. 21, 2021

(51) Int. Cl.
*F01D 25/24* (2006.01)
*F01D 21/00* (2006.01)

(52) U.S. Cl.
CPC ..... *F01D 21/003* (2013.01); *F01D 25/24* (2013.01); *F05D 2240/14* (2013.01); *F05D 2240/55* (2013.01); *F05D 2260/31* (2013.01); *F05D 2260/38* (2013.01); *F05D 2260/80* (2013.01)

(58) Field of Classification Search
CPC .... F01D 21/003; F01D 25/24; F05D 2240/14; F05D 2240/55; F05D 2260/31; F05D 2260/38; F05D 2260/80
See application file for complete search history.

(56) References Cited

U.S. PATENT DOCUMENTS 3,157,258 A * 11/1964 Cronholm ..... B25B 23/142 192/69.82
3,362,160 A * 1/1968 Bourgeois ..... F01D 21/003 415/126
4,591,794 A * 5/1986 Shattuck ..... F01D 21/003 340/627
4,815,276 A 3/1989 Hansel et al.
5,115,636 A * 5/1992 Zeiser ..... F01D 21/003 60/803
5,867,976 A 2/1999 Ziegler, Jr.
6,468,033 B1 * 10/2002 Weidlich ..... F01D 21/003 415/118
7,231,817 B2 * 6/2007 Smed ..... G01M 15/10 73/112.01
8,047,769 B2 * 11/2011 Ballard, Jr. ..... F01D 25/00 415/138
8,197,187 B2 * 6/2012 Walker ..... F01D 25/24 415/118
9,494,052 B2 * 11/2016 Feindel ..... F01D 21/003
9,880,070 B2 * 1/2018 Feindel ..... G01M 15/14
9,988,929 B2 * 6/2018 Smith ..... G02B 23/2492
10,041,413 B2 * 8/2018 Huang ..... F23R 3/60
10,618,665 B2 * 4/2020 Leutard ..... F01D 21/003
(Continued)

*Primary Examiner* — Igor Kershteyn
*Assistant Examiner* — Theodore C Ribadeneyra
(74) *Attorney, Agent, or Firm* — Cantor Colburn LLP

(57) ABSTRACT

A method for assembling a plug assembly for plugging one or more ports of a gas turbine engine including that a first arm is inserted into a sheath through-passage of a sheath. The method includes a second arm is inserted into the sheath through-passage of the sheath. The method further includes a separating mechanism is inserted into the sheath through-passage between the first arm and the second arm, a biasing mechanism is installed, and a top housing is slid over the biasing mechanism such that the biasing mechanism is located in a cavity defined within the top housing. The biasing mechanism being configured to apply a force to the first arm and the second arm when the biasing mechanism is located in the cavity. The method may also include that the top housing is secured together with the sheath.

20 Claims, 8 Drawing Sheets

(56) References Cited

U.S. PATENT DOCUMENTS

| | | | | |
|---|---|---|---|---|
| 11,085,322 | B2 * | 8/2021 | Ha | G02B 23/2492 |
| 11,434,774 | B2 * | 9/2022 | O'Neill | F01D 9/042 |
| 2009/0178385 | A1 * | 7/2009 | Sandelis | F02C 7/266 60/39.821 |
| 2016/0369701 | A1 * | 12/2016 | Pireyre | F23R 3/10 |

* cited by examiner

RESTRAINING PLUG

BACKGROUND

The subject matter disclosed herein relates generally to gas turbine engines and, more particularly, to a plug for plugging an inspection port in a gas turbine engine.

Gas turbine engines typically operate at high rotational speeds and high temperatures for increased performance and efficiency. In many cases, performance of an engine may be tied to proper operation and function of engine components. During operation, components may be damaged, fail or otherwise require maintenance. In addition, control of an engine may be based on the operation of components within an engine. Safety inspections and routine maintenance are often required to ensure safe operation and prevent engine failure. Many gas turbine engines include inspection ports to allow for inspection and/or maintenance of an engine. Conventional methods of sealing these ports are can be expensive and in some cases, may lead to foreign object damage (FOD) due to improper installation during manufacture or maintenance. Moreover, some gas turbine engines may have dozens of ports. In addition, correct operation and installation of port components may be required for safe and efficient operation of an engine. There is a need in the art for port components for gas turbine engines.

BRIEF DESCRIPTION

According to one embodiment, a method for assembling a plug assembly for plugging one or more ports of a gas turbine engine is provided. The method includes a first arm is inserted into a sheath through-passage of a sheath. The first arm including a first longitudinal portion and a first projection portion. The method also includes the first projection portion is inserted through a first opening in a passageway portion of the sheath. The method includes a second arm is inserted into the sheath through-passage of the sheath. The second arm including a second longitudinal portion and a second projection portion. The method further includes the second projection portion is inserted through a second opening in the passageway portion of the sheath, a separating mechanism is inserted into the sheath through-passage between the first arm and the second arm, a biasing mechanism is installed, and a top housing is slid over the biasing mechanism such that the biasing mechanism is located in a cavity defined within the top housing. The biasing mechanism being configured to apply a force to the first arm and the second arm when the biasing mechanism is located in the cavity. The method may also include that the top housing is secured together with the sheath.

In addition to one or more of the features described above, or as an alternative, further embodiments may include a slider seal housing is secured onto a radially outward surface of an inner casing of the gas turbine and a slider seal is inserted into the slider seal housing, the slider seal housing including a slider seal seat configured to fit the slider seal therein. The method may also include that a slider seal cover is secured to the slider seal housing. The slider seal cover being configured to secure the slider seal in the slider seal housing.

In addition to one or more of the features described above, or as an alternative, further embodiments may include that the inner casing further includes an inner port. The slider seal housing further includes a slider seal housing through-passage aligned with the inner port. The slider seal further includes a seal through-passage aligned with the inner port.

The slider seal cover further includes a cover through-passage aligned with the inner port. The method further includes that an inner end of the sheath is inserted through the cover through-passage, the seal through-passage, and the slider seal housing through-passage. The method further includes that the inner end of the sheath is inserted into the inner port of the inner casing of the gas turbine engine.

In addition to one or more of the features described above, or as an alternative, further embodiments may include that an inner end of the sheath is inserted into an inner port of an inner casing of the gas turbine engine.

In addition to one or more of the features described above, or as an alternative, further embodiments may include that the plug assembly is secured to the gas turbine engine.

In addition to one or more of the features described above, or as an alternative, further embodiments may include that the plug assembly is secured to an outer casing of the gas turbine engine.

In addition to one or more of the features described above, or as an alternative, further embodiments may include that the plug assembly is secured to the gas turbine engine by aligning a housing through-passage within the top housing and a flange through-passage within a flange portion of the sheath with a threaded hole in the outer casing or in a component attached to the outer casing, inserting a fastening mechanism through the housing through-passage and through the flange through-passage, and rotating the fastening mechanism such that a threaded portion of the fastening mechanism interlocks with the threaded hole to secure the plug assembly to the gas turbine engine.

In addition to one or more of the features described above, or as an alternative, further embodiments may include that the separating mechanism is a separator body. The separator body includes a lower end, an upper end located opposite the lower end, and a separator body flange located between the lower end and the upper end. The separator body flange dividing the separator body into a lower portion located at or proximate the lower end and an upper portion located at or proximate the upper end.

In addition to one or more of the features described above, or as an alternative, further embodiments may include that the lower end is pointed or wedge shaped.

In addition to one or more of the features described above, or as an alternative, further embodiments may include that the biasing mechanism is installed by sliding the biasing mechanism onto the upper portion of the separator body.

In addition to one or more of the features described above, or as an alternative, further embodiments may include that a c-seal is placed on the first arm and the second arm.

In addition to one or more of the features described above, or as an alternative, further embodiments may include that the separating mechanism is a spring.

In addition to one or more of the features described above, or as an alternative, further embodiments may include that the biasing mechanism is a spring.

In addition to one or more of the features described above, or as an alternative, further embodiments may include that the separating mechanism is a wedge shaped body. The first longitudinal portion and the second longitudinal portion have a wedge shape.

In addition to one or more of the features described above, or as an alternative, further embodiments may include that the separating mechanism is a connector arm connecting the first arm to the second arm.

According to another embodiment, a plug assembly for plugging one or more ports of a gas turbine engine is provided. The plug assembly includes a sheath that includes an inner end, an outer end located opposite the inner end, a passageway portion located at or proximate the inner end, a sheath through-passage extending from the outer end to a sheath through-passage base proximate the inner end, a first opening in the passageway portion, and a second opening in the passageway portion. The plug assembly also includes a first arm that includes a first longitudinal portion located in the sheath through-passage and a first projection portion projecting through the first opening. The plug assembly further includes a second arm including a second longitudinal portion located in the sheath through-passage and a second projection portion projecting through the second opening. The plug assembly yet further includes a separating mechanism located in the sheath through-passage between the first arm and the second arm. The separating mechanism configured to separate the first arm from the second arm. The plug assembly also includes a biasing mechanism configured to apply a force to the first arm and the second arm. The force is parallel to the first longitudinal portion and the second longitudinal portion. The plug assembly further includes a top housing abutting the outer end of the sheath. The top housing including a cavity formed therein. The biasing mechanism is located in the cavity.

In addition to one or more of the features described above, or as an alternative, further embodiments may include that the separating mechanism is a separator body and the separator body includes a lower end, an upper end located opposite the lower end, and a separator body flange located between the lower end and the upper end. The separator body flange dividing the separator body into a lower portion located at or proximate the lower end and an upper portion located at or proximate the upper end.

In addition to one or more of the features described above, or as an alternative, further embodiments may include that the lower end is pointed or wedge shaped to help drive the first arm and the second arm apart.

In addition to one or more of the features described above, or as an alternative, further embodiments may include that the biasing mechanism is located on the upper portion of the separator body.

In addition to one or more of the features described above, or as an alternative, further embodiments may include that the separating mechanism is a spring.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
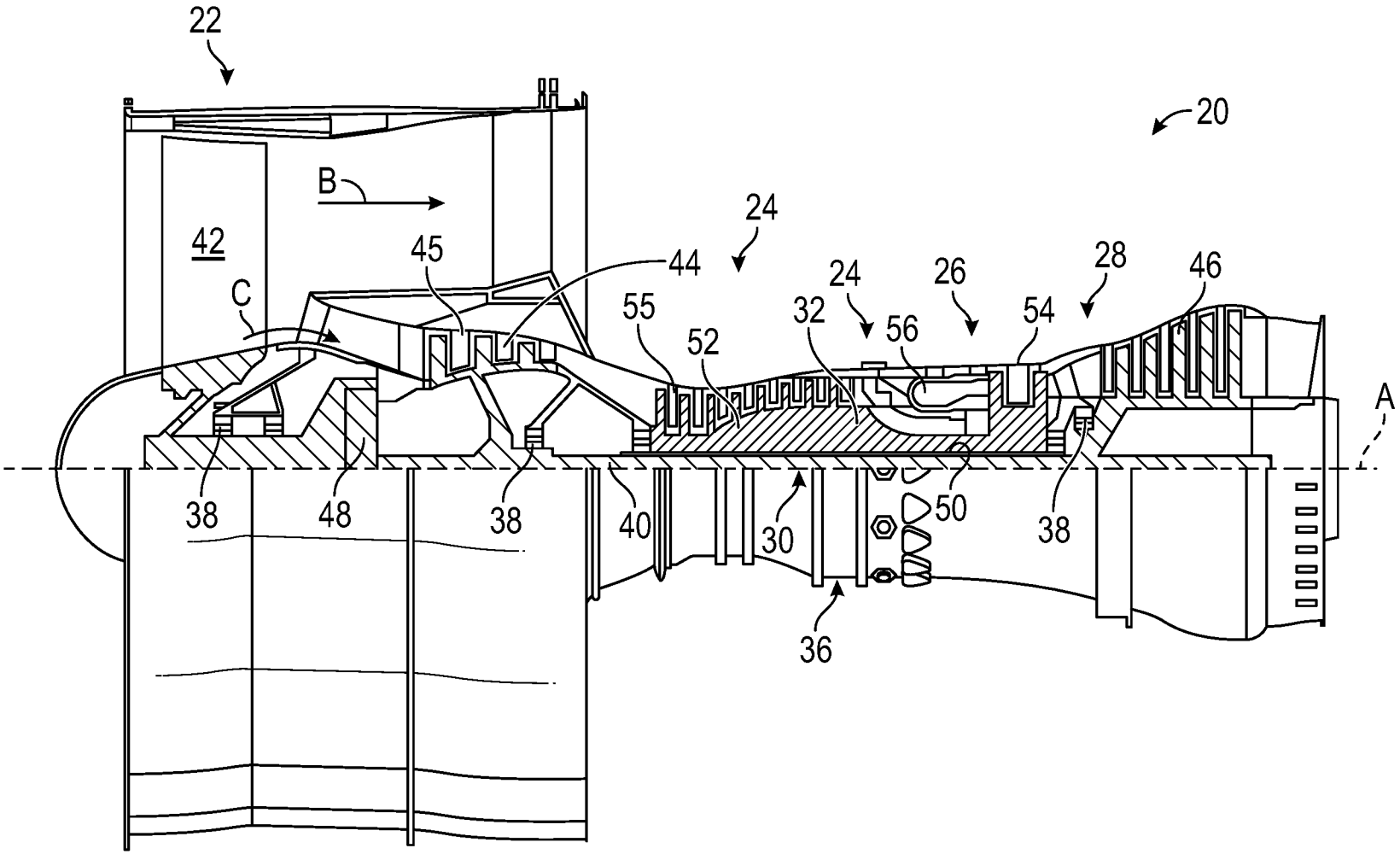
FIG. 1 is a partial cross-sectional illustration of a gas turbine engine, in accordance with an embodiment of the disclosure.

FIG. 1 schematically illustrates a gas turbine engine 20. The gas turbine engine 20 is disclosed herein as a two-spool turbofan that generally incorporates a fan section 22, a compressor section 24, a combustor section 26, and a turbine section 28. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. In some embodiments, stator vanes 45 in the low pressure compressor 44 and stator vanes 55 in the high pressure compressor 52 may be adjustable during operation of the gas turbine engine 20 to support various operating conditions. In other embodiments, the stator vanes 45, 55 may be held in a fixed position. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 3:
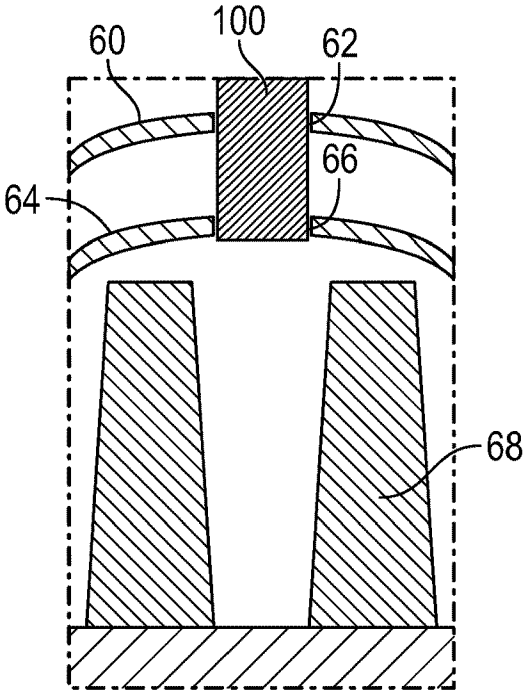
FIG. 3 is an axial view graphical representation of a plug assembly located within a gas turbine engine, in accordance with an embodiment of the disclosure.
Figure 2:
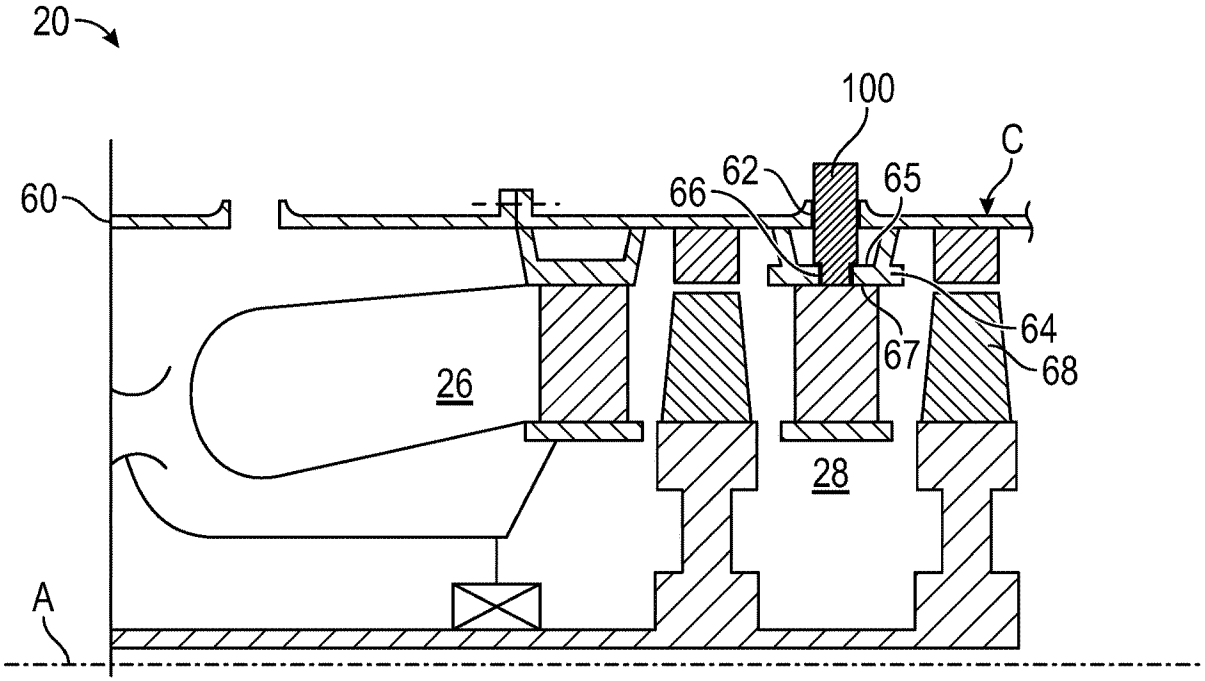
FIG. 2 is a side view graphical representation of a plug assembly located within a gas turbine engine, in accordance with an embodiment of the disclosure.

Referring now to FIGS. 2 and 3, with continued reference to FIG. 1, a graphical representation of a plug assembly 100 (see also FIGS. 3-10) located within a gas turbine engine 20 is illustrated, in accordance with an embodiment of the present disclosure.

The plug assembly 100 may be a borescope plug assembly and inspection port assembly. The plug assembly 100 are shown within an outer port 62 located within an outer casing 60 of the gas turbine engine 20 and an inner port 66 located in an inner casing 64 of the gas turbine engine 20. The outer port 62 may be a borescope port or an inspection port. In an embodiment, the outer casing 60 may be a high pressure turbine case. The outer casing 60 may also be a lower pressure turbine case, a diffuser case, a high pressure compressor case, or any other case that requires an in section port in the gas turbine engine 20.

The plug assembly 100 extend radially inward toward the engine central longitudinal axis A of the gas turbine engine 20. As illustrated in FIG. 2, the plug assembly 100 may extend from the inner port 66 to the outer port 62. The inner casing 64 is located radially inward from the outer casing 60. The inner casing 64 may be a mid-turbine frame (MTF) vane casing. It is understood that the inner casing 64 is not limited to the MTF vane casing and the embodiment described herein are applicable to the inner casing 64 being any other casing or component located within the gas turbine engine 20 that is radially inward from the outer casing 60. The inner casing 64 includes a radially inward surface 67 and a radially outward surface 65 located opposite the radially inward surface 67. The radially outward surface 65 is located radially outward of the radially inward surface 67. The inner port 66 extends from the radially inward surface 67 to the radially outward surface 65.

In one embodiment, the inner port 66 and the outer port 62 may be located in the turbine section 28 of the gas turbine engine 20. It is understood that the embodiments disclosed herein are not limited to the inner port 66 and the outer port 62 being located in the turbine section 28 of the gas turbine engine 20, and therefore the inner port 66 and the outer port 62 may be located in other sections of the gas turbine engine. The turbine section 28 is located aft of the combustor section 26. The turbine section 28 includes a plurality of vanes 68 extending circumferentially around the engine central longitudinal axis A. The inner port 66 and the outer port 62 may be located interposed circumferentially between two adjacent vanes 68, as illustrated in FIG. 3.

Removal of at least a portion or an entirety of the plug assembly 100 from the outer port 62 and the inner port 66 may allow inspection into the outer port 62 and inner port 66. As such, the plug assembly 100 provides access to the gas turbine engine 20 radially inward of the outer port 62 and/or the inner port 66 for mechanical diagnostics or other diagnostic reasons.

Figure 4:
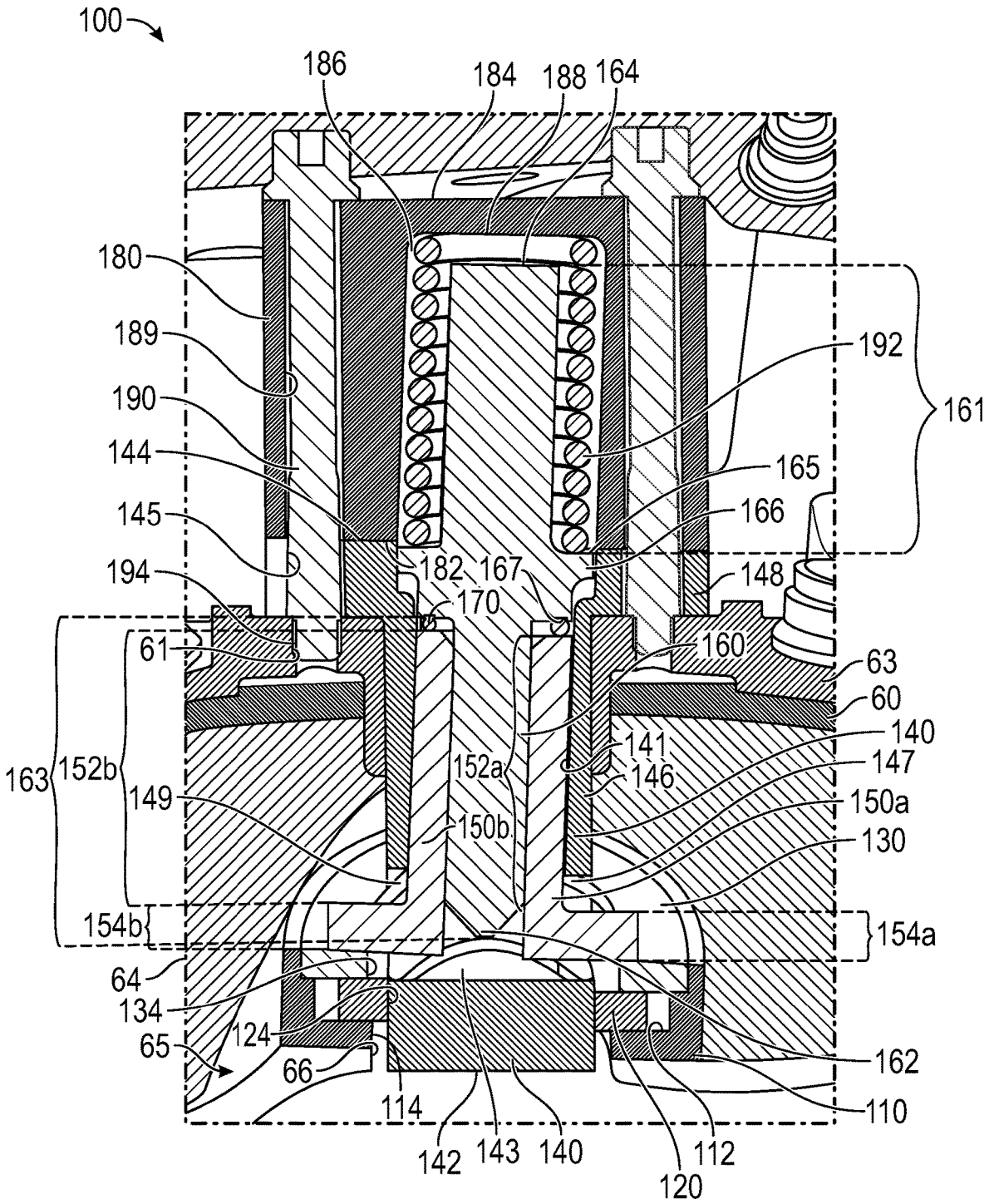
FIG. 4 is a cross-sectional view of a plug assembly, in accordance with an embodiment of the disclosure.

Referring now to FIG. 4, with continued reference to FIGS. 1-3, a cross-sectional view of a plug assembly 100 is illustrated, in accordance with an embodiment of the present disclosure.

The plug assembly 100 may be configured to secure an outer casing 60 in place, a slider seal housing 110 in place, a slider seal 120 in place, a slider seal cover 130 in place, or any other component of the gas turbine engine 20 in place. Further it is understood that while the plug assembly 100 has been described herein as securing the slider seal cover 130 in place, the plug assembly 100 may secure any component of the gas turbine engine 20 in place.

The plug assembly 100 of FIG. 4 may include the slider seal housing 110, the slider seal 120, the slider seal cover 130, a sheath 140, a first arm **150*a*, a second arm 150*b*, a separator body 160, a c-seal 170, a top housing 180, one or more fastening mechanism 190, and a biasing mechanism 192**.

The slider seal housing 110 abuts the radially outward surface 65 of the inner casing 64. The slider seal housing 110 may be secured to the radially outward surface 65 of the inner casing 64. The slider seal housing 110 may be secured to the radially outward surface 65 of the inner casing 64 via a weld or any other attachment method know to one of skill in the art. The slider seal housing 110 includes a slider seal seat 112 configured to fit the slider seal 120 therein. The slider seal 120 is configured to fit within the slider seal seat 112. The slider seal 120 is secured within the slider seal seat 112 by a slider seal cover 130. The slider seal cover 130 is secured to the slider seal housing 110. The slider seal cover 130 may be secured to the slider seal housing 110 via a weld or any other attachment method know to one of skill in the art. The slider seal cover 130 is configured to maintain or entrap the slider seal 120 within the slider seal housing 110 such that the slider seal 120 is free to slide between the slider seal cover 120 and slider seal housing 110 and is not fixed in place. The slider seal cover 130 may be configured to allow the slider seal 120 to move freely relative to the slider seal cover 130 and the slider seal housing 110.

The slider seal housing 110 may be circular in shape with a slider seal housing through-passage 114. The slider seal 120 may be circular in shape with a seal through-passage 124. The slider seal cover 130 may be circular in shape with a cover through-passage 134. The sheath 140 is configured to pass through the slider seal housing through-passage 114, the seal through-passage 124, and the cover through passage 134 to plug the inner port 66.

The sheath 140 includes an inner end 142 and outer end 144 located radially outward from the inner end 142 when the plug assembly 100 is installed in the gas turbine engine 20. The inner end 142 of the sheath 140 is configured to plug the inner port 66 and the outer end 144 of the sheath 140 abuts the top housing 180. The sheath 140 includes a passageway portion 146 and a flange portion 148. The passageway portion 146 is located at or proximate the inner end 142 and the flange portion 148 is located at or proximate the outer end 144. A sheath through-passage 141 extends through the sheath 140 from the outer end 144 to a sheath through-passage base 143 proximate the inner end 142. The sheath through-passage 141 is a blind hole as it does not pass completely through the inner end 142.

The top housing 180 includes a top end 184 and a bottom end 182 located opposite the top end 184. The bottom end 182 of the top housing 180 abuts the inner end 142 of the sheath 140. The top housing 180 includes a cavity 186 extending from the bottom end 182 of the top housing 180 into the top housing 180 to a base 188. The cavity 186 is a blind hole as it does not pass completely through the top housing 180.

The cavity 186 is configured to align with the sheath through-passage 141. The separator body 160 is located within the combined cavity defined by the cavity 186 and the sheath through-passage 141. Thus, the separator body 160 extends across the cavity 186 and the sheath through-passage 141.

The separator body 160 includes a lower end 162 and an upper end 164 located opposite the lower end 162. The upper end 164 is located proximate the base 188 of the cavity 186 in the top housing 186. The lower end 162 may be pointed or wedge shaped to help drive the arms 150 apart during installation, as discussed further herein. The separator body 160 includes a separator body flange 166 located between the upper end 164 and the lower end 162. The separator body flange 166 includes an upper surface 165 and a lower surface 167 located opposite the upper surface 165.

The separator body flange 166 divides or separates the separator body flange 166 into an upper portion 161 and a lower portion 163. The upper portion 161 is located at or proximate the upper end 164 and the lower portion 163 is located at or proximate the lower end 162.

The biasing mechanism 192 is interposed between the base 188 of the cavity 186 and the upper surface 165 of the separator body flange 166. In an embodiment, the biasing mechanism 192 may be a spring. The biasing mechanism 192 applies a force against the base 188 and the upper surface 165 and pushes the upper surface 165 and the separator body 160 radially inward towards the inner port 66, which applies a radially inward force to the first arm 150*a* and the second arm 150*b*, which applies a force to maintain the slider seal cover 130 in place in the event welds were to fail between the slider seal cover 130 and the slider seal housing 110 or between the slider seal housing 110 and the inner casing 64. The c-seal 170 may be located interposed between the lower surface 167 and the first arm 150*a* and the second arm 150*b* as illustrated in FIG. 4.

The first arm 150*a* includes a first longitudinal portion 152*a* and a first projection portion 154*a*. The first projection portion 154*a* may be oriented at about a right angle (e.g., 90 degrees) to the first longitudinal portion 152*a*. The first projection portion 154*a* applies the aforementioned force to the slider seal cover 130.

The second arm 150*b* includes a second longitudinal portion 152*b* and a second projection portion 154*b*. The second projection portion 154*b* may be oriented at about a right angle (e.g., 90 degrees) to the second longitudinal portion 152*b*. The second projection portion 154*b* applies the aforementioned force to the slider seal cover 130.

The plug assembly 100 of FIG. 4 uses the separator body 160 as a separating mechanism to push the first arm 150*a* and the second arm 150*b* apart. The separator body 160 may help drive and/or maintain the first projection portion 154*a* through a first opening 147 in a passageway portion 146 of the sheath 140 and the second projection portion 154*b* through a second opening 149 in the passageway portion 146 of the sheath 140. The first opening 147 and the second opening 149 may be oriented about perpendicular with the sheath through-passage 141 of the sheath 140

The plug assembly 100 further includes one or more fastening mechanism 190 configured to secure the top housing 180 together with the sheath 140. More specifically, the fastening mechanism 190 secures the top housing 180 to the flange portion 148 of the sheath 140. The one or more fastening mechanisms 190 are configured to secure the plug assembly 100 to the outer casing 60 or to a component 63 attached to the outer casing 60. The component 63 may be a boss attached to the outer casing 60. The one or more fastening mechanisms 190 passes through the top housing 180 and the flange portion 148 of the sheath 140 to secure the plug assembly 100 to the outer casing 60. In an embodiment, the fastening mechanism 190 may be a bolt. The fastening mechanism 190 may have a threaded portion 194. The fastening mechanism 190 passes through a housing through-passage 189 in the top housing 180 and a flange through-passage 145 within the flange portion 148 to secure within a threaded hole 61 located in the outer casing 60 or in the component 63 attached to the outer casing 60. The threaded portion 194 is configured to interlock with the threaded hole 61 when the fastening mechanism 190 is rotated.

Figure 5A:
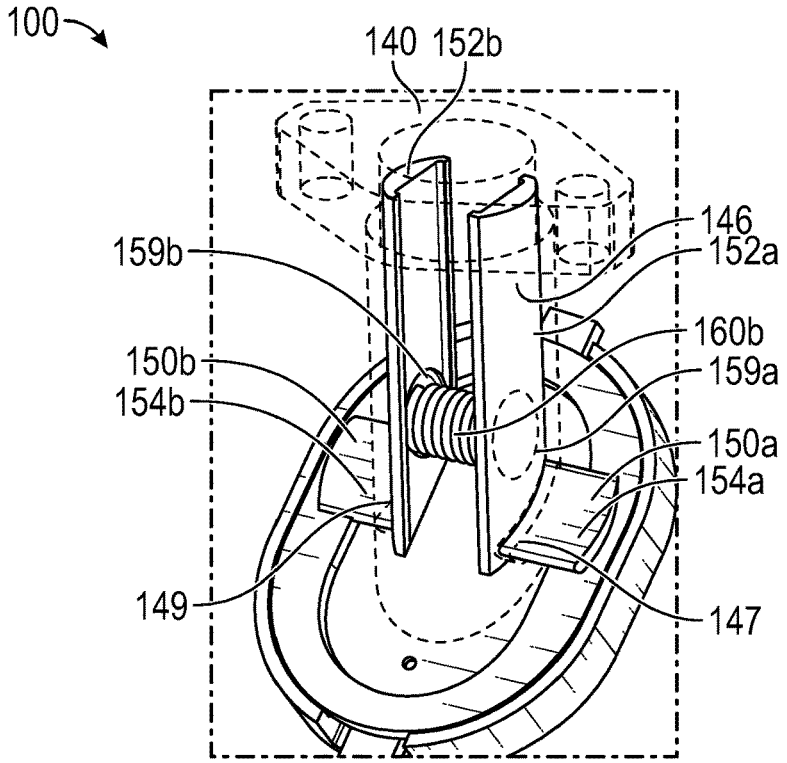
FIG. 5A is schematic illustration of an alternate embodiment of a separating mechanism for use in the plug assembly, in accordance with an embodiment of the disclosure.

Referring now to FIG. 5A, with continued reference to FIGS. 1-4, an alternate embodiment of a separating mechanism for use in the plug assembly 100 is illustrated, in accordance with an embodiment of the present disclosure. The outer case 60, the outer port 62, and the component 63 have been hidden from view in FIG. 5A to better illustrate the plug assembly 100. The plug assembly 100 of FIG. 5A uses a spring 160*b* as a separating mechanism (rather than the separator body 160 of FIG. 4) to push the first arm 150*a* and the second arm 150*b* apart. The spring 160*b* drives and/or maintains the first projection portion 154*a* through a first opening 147 in a passageway portion 146 of the sheath 140 and the second projection portion 154*b* through a second opening 149 in the passageway portion 146 of the sheath 140.

The spring 160*b* may be placed between the first arm 150*a* and the second arm 150*b* during assembly. The spring 160*b* may be seated in a first indent 159*a* located in the first longitudinal portion 152*a* of the first arm 150*a* and a second indent 159*b* located in the second longitudinal portion 152*b* of the second arm 150*b*.

Figure 5B:
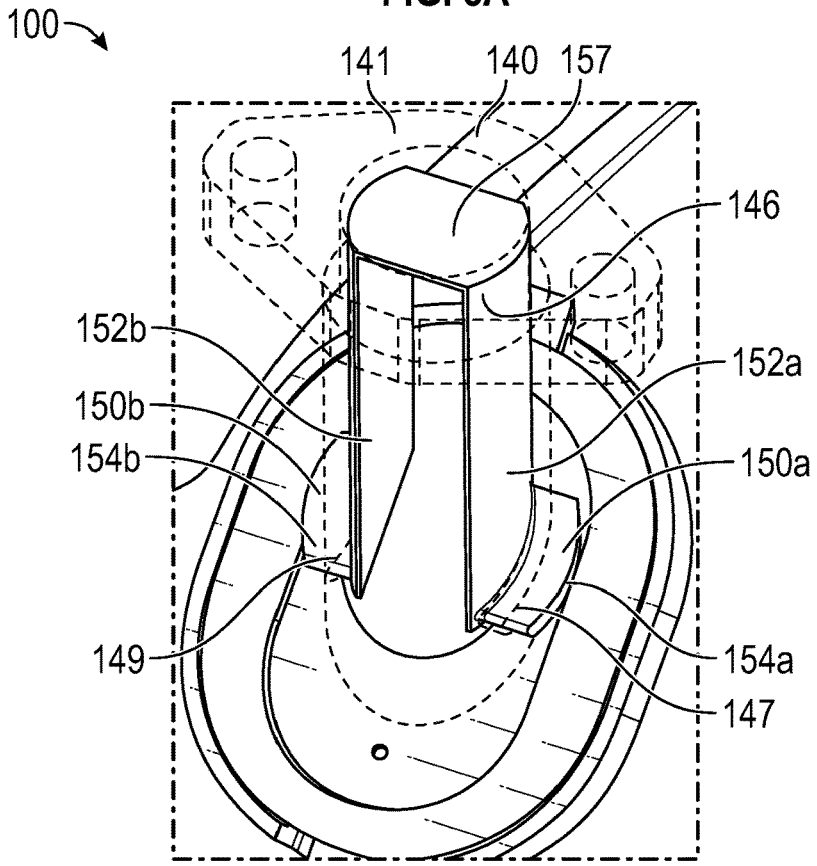
FIG. 5B is schematic illustration of an alternate embodiment of a separating mechanism for use in the plug assembly, in accordance with an embodiment of the disclosure.

Referring now to FIG. 5B, with continued reference to FIGS. 1-4, an alternate embodiment of a separating mechanism for use in the plug assembly 100 is illustrated, in accordance with an embodiment of the present disclosure. The outer case 60 and the outer port 62 have been hidden from view in FIG. 5B to better illustrate the plug assembly 100. The plug assembly 100 of FIG. 5B uses a connecting arm 157 as a separating mechanism (rather than the separator body 160 of FIG. 4) to push the first arm 150*a* and the second arm 150*b* apart. The connecting arm 157 connects the first arm 150*a* to the second arm 150*b*. During installation the first arm 150*a* to the second arm 150*b* are pinched together to fit into the sheath through-passage 141 and then the first arm 150*a* to the second arm 150*b* spring back into place to drive and/or maintain the first projection portion 154*a* through a first opening 147 in a passageway portion 146 of the sheath 140 and the second projection portion 154*b* through a second opening 149 in the passageway portion 146 of the sheath 140. The first arm 150*a*, the second 150*b*, and the connecting arm 157 have a predetermined rigidity to allow the first arm 150*a* and the second arm 150*b* to pinch together and then expand back out again.

Figure 7:
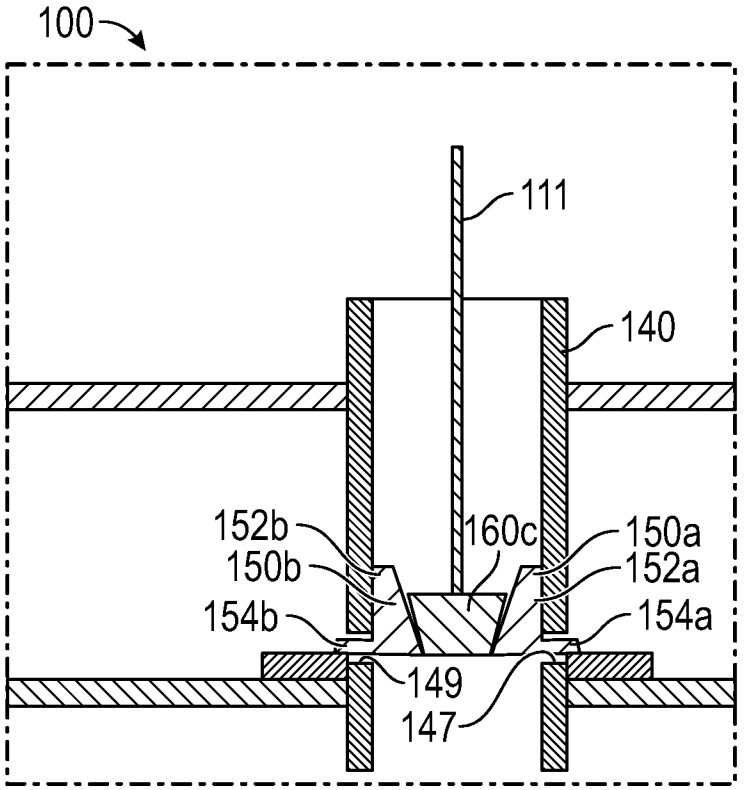
FIGS. 6 and 7 are schematic illustrations of an alternate embodiment of a separating mechanism for use in the plug assembly, in accordance with an embodiment of the disclosure.
Figure 6:
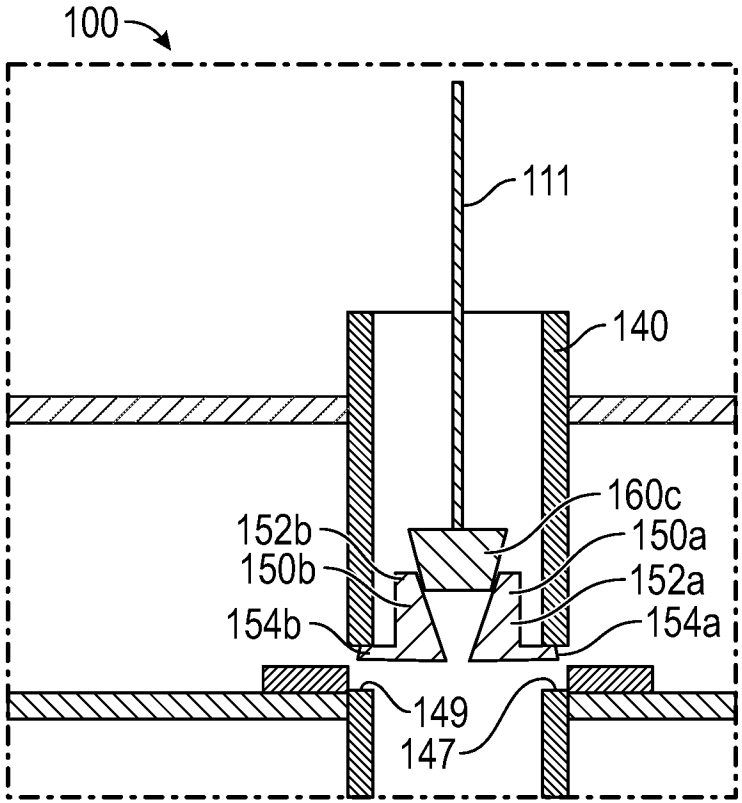

Referring now to FIGS. 6 and 7, with continued reference to FIGS. 1-4, an alternate embodiment of a separating mechanism for use in the plug assembly 100 is illustrated, in accordance with an embodiment of the present disclosure. The plug assembly 100 of FIGS. 6 and 7 uses a wedge shaped body 160*c* as a separating mechanism (rather than the separator body 160 of FIG. 4) to push the first arm 150*a* and the second arm 150*b* apart.

The wedge shaped body 160*c* drives and/or maintains the first projection portion 154*a* through a first opening 147 in a passageway portion 146 of the sheath 140 and the second projection portion 154*b* through a second opening 149 in the passageway portion 146 of the sheath 140. The wedge shaped body 160*c* may be placed between the first arm 150*a* and the second arm 150*b* during assembly. A positioning bar 111 may be attached to the wedge shaped body 160*c* to insert the wedge shaped body 160*c* into place and/or maintain the wedge shaped body 160*c* in place. In one embodiment, the positioning bar 111 may have threads that mate with the sheath 140 in order to screw the positioning bar 111 into the sheath 140 and push and/or maintain the wedge shaped body 160*c* in place. Alternatively, the positioning bar 111 may have no threads. In another embodiment, the positioning bar 111 may be held in place by a locking pin.

In an embodiment, the first longitudinal portion 152*a* and the second longitudinal portion 152*b* may also have a wedge shape, as illustrated in FIGS. 6 and 7.

Figure 8A:
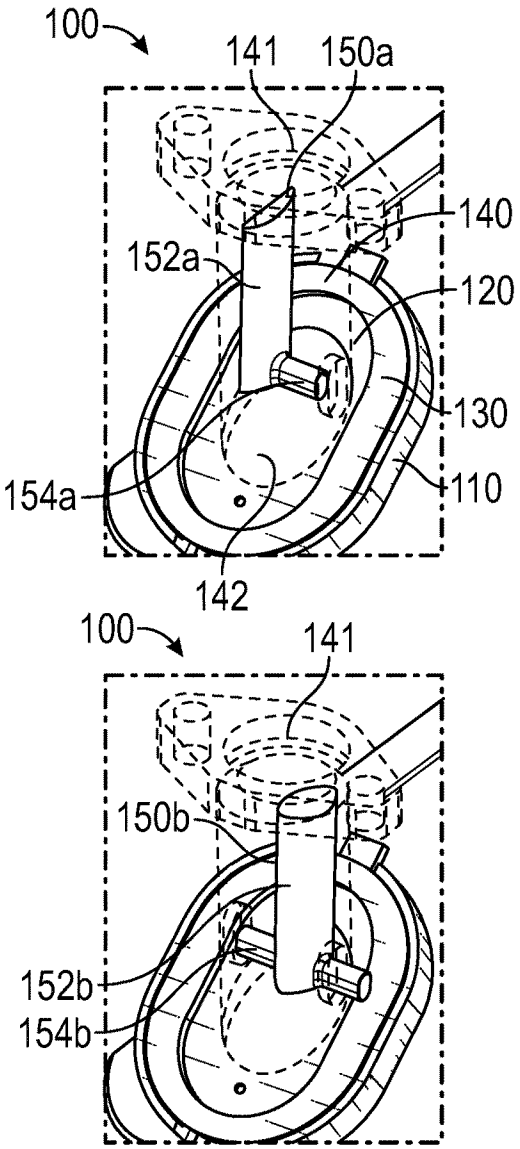
FIGS. 8A, 8B, and 8C is a flow chart illustrating a method of assembling the plug assembly for plugging one or more ports of a gas turbine engine, in accordance with an embodiment of the disclosure.
Figure 8A:
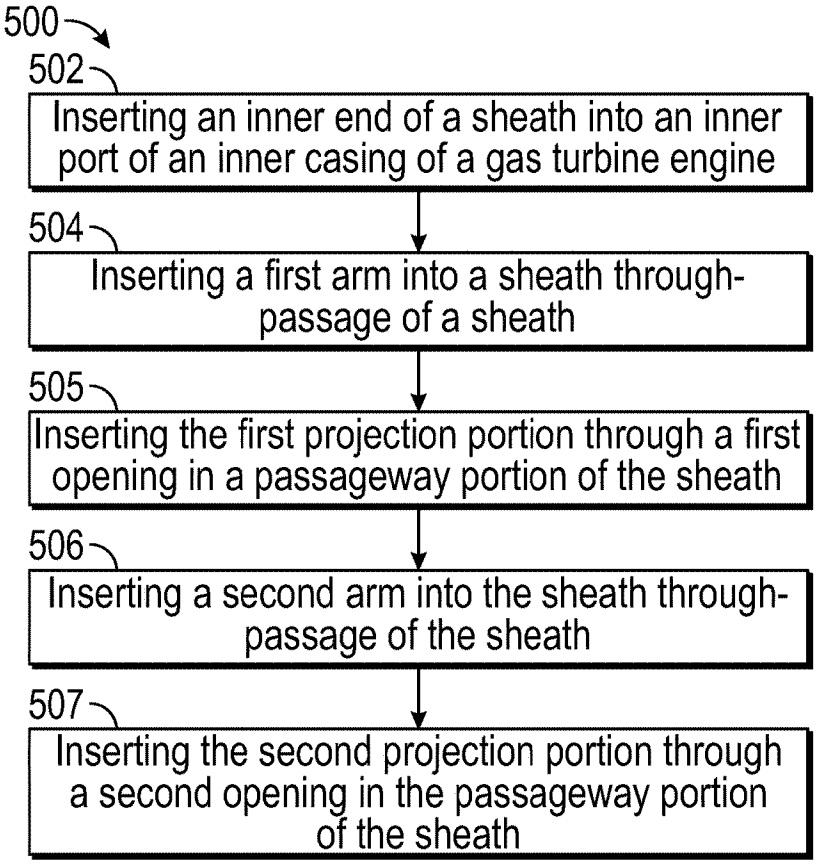
Figure 8B:
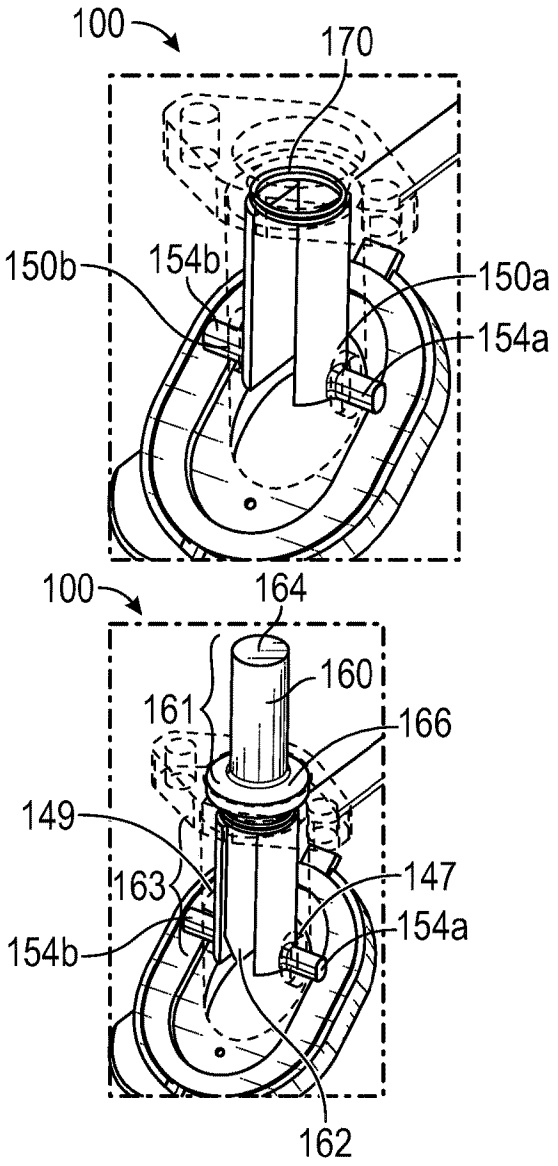
Figure 8B:
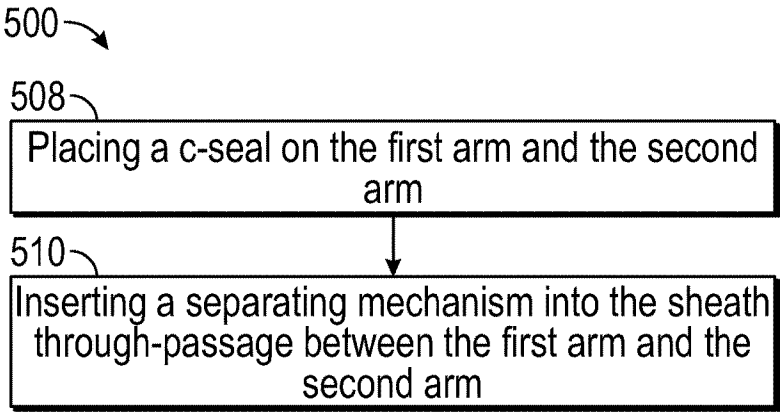
Figure 8C:
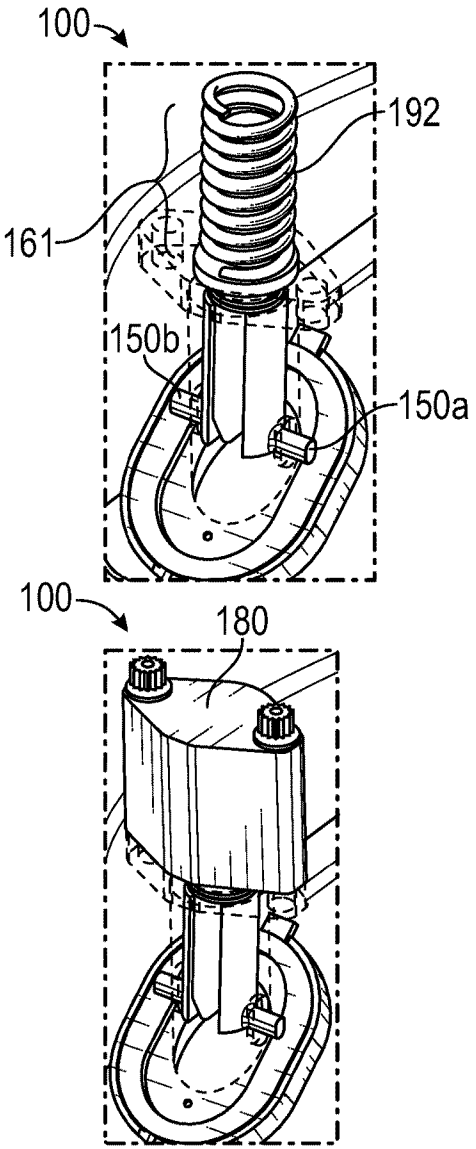
Figure 8C:
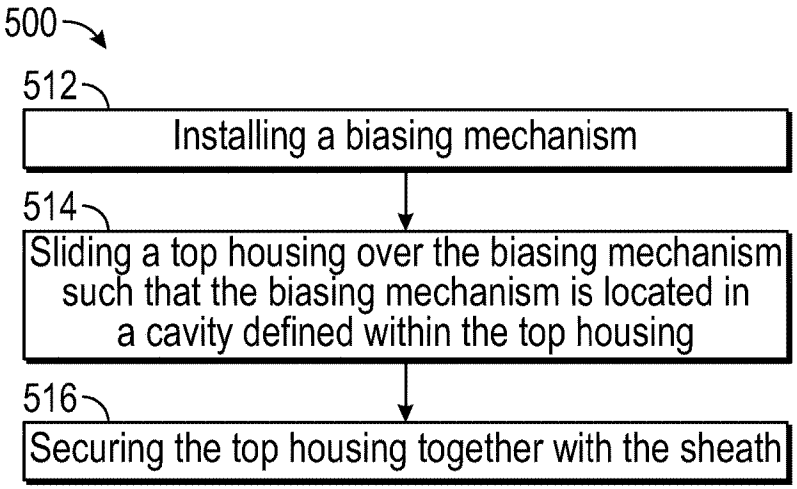

Referring now to FIGS. 8A, 8B, and 8C, with continued reference to FIGS. 1-7, a flow chart of a method 500 of assembling the plug assembly 100 for plugging one or more ports 66, 62 of a gas turbine engine 20 is illustrated, in accordance with an embodiment of the present disclosure. The outer case 60 and the outer port 62 have been hidden from view in FIGS. 8A, 8B, and 8C to better illustrate the plug assembly 100.

It is understood that while the method 500 is being illustrated and described largely with the embodiments of FIG. 4, the method 500 is not limited to the embodiments illustrated in FIG. 4 and may also be applicable to the embodiments illustrated in FIGS. 5 and 6.

At block 502, the inner end 142 of the sheath 140 is inserted into an inner port 66 of an inner casing 64 of the gas turbine engine 20.

The plug assembly 100 may be configured to secure the outer casing 60 in place, a slider seal housing 110 in place, a slider seal 120 in place, a slider seal cover 130 in place, or any other component of the gas turbine engine 20 in place. The method 500 may further include that a slider seal housing 110 is secured onto a radially outward surface 65 of an inner casing 64 of the gas turbine 20. The method 500 may further include that a slider seal 120 is inserted into the slider seal housing 110. The slider seal housing 110 include a slider seal seat 112 configured to fit the slider seal 120 therein. The method 500 may further include that a slider seal cover 130 is secured to the slider seal housing 110. The slider seal cover 130 being configured to secure the slider seal 120 in the slider seal housing 110. The method 500 may further include that an inner end 142 of the sheath 140 is inserted through the cover through-passage 134, the seal through-passage 124, and the slider seal housing through-passage 114 and then the inner end 142 of the sheath 140 is inserted into an inner port 66 of an inner casing 64 of the gas turbine engine 20 (See FIG. 4).

At block 504, a first arm 150*a* is inserted into a sheath through-passage 141 of a sheath 140. The first arm 150*a* comprising a first longitudinal portion 152*a* and a first projection portion 154*a*. The first projection portion 154*a* may be oriented at about a right angle to the first longitudinal portion 152*a*.

At block 505, the first projection portion 154*a* of the first arm 150*a* is inserted through the first opening 147 prior to block 506.

At block 506, a second arm 150*b* is inserted into the sheath through-passage 141 of the sheath 140. The second arm 150*b* comprising a second longitudinal portion 152*b* and a second projection portion 154*b*. The second projection portion 154*b* may be oriented at about a right angle to the second longitudinal portion 152*b*.

At block 507, the second projection portion 154*b* of the second arm 150*b* is inserted through the second opening 149 prior to block 506.

At block 508, a c-seal 170 may be placed on the first arm 150*a* and the second arm 150*b*. Block 508 may be optional if a c-seal 170 is not required.

At block 510, a separating mechanism is inserted into the sheath through-passage 141 between the first arm 150*a* and the second arm 150*b*. The separating mechanism separates the first arm 150*a* from the second arm 150*b*. More specifically, the separating mechanism separates the first longitudinal portion 152*a* from the second longitudinal portion 152*b*.

In an embodiment, the separating mechanism may be a separator body 160. The separator body 160 may include a lower end 162, an upper end 164 located opposite the lower end 162, a separator body flange 166 dividing the separator body 160 into a lower portion 163 located at or proximate the lower end 162, and an upper portion 161 located at or proximate the upper end 164. The lower end 162 may be pointed or wedge shaped to help drive the first arm 150*a* and the second arm 150*b* apart in block 510. In an embodiment, the separating mechanism is a wedge shaped body 160*c* and the first longitudinal portion 152*a* and the second longitudinal portion 152*b* have a wedge shape.

At block 512, a biasing mechanism 192 is installed. In an embodiment, the biasing mechanism 192 may be a spring. The biasing mechanism 192 may be slid onto the upper portion 161 of the separator body 160.

At block 514, a top housing 180 is slid over the biasing mechanism 192 such that the biasing mechanism 192 is located in a cavity 186 defined within the top housing 180. The biasing mechanism 192 may be configured to apply a force to the first arm 150*a* and the second arm 150*b* when the biasing mechanism 192 is located in the cavity 186. The force being parallel to the first longitudinal portion 152*a* and the second longitudinal portion 152*b*.

At block 516, the top housing 180 is secured together with the sheath 140. The method 500 may further include that the plug assembly 100 is secured to the gas turbine engine 20. More specifically, the plug assembly 100 is secured to an outer casing 60 of the gas turbine engine 20. The plug assembly 100 may be secured to the gas turbine engine 20 by aligning a housing through-passage 189 within the top housing 180 and a flange through-passage 145 within a flange portion 148 of the sheath 140 with a threaded hole 61 in the outer casing 60 or in a component 63 attached to the outer casing 60, inserting a fastening mechanism 190 through the housing through-passage 189 and through the flange through-passage 145, and rotating the fastening mechanism 190 such that a threaded portion 194 of the fastening mechanism 190 interlocks with the threaded hole 61 to secure the plug assembly 100 to the gas turbine engine 20.

While the above description has described the flow process of FIGS. 8A, 8B, and 8C in a particular order, it should be appreciated that unless otherwise specifically required in the attached claims that the ordering of the steps may be varied.

As used herein radially outward is intended to be in the direction away from the engine central longitudinal axis A and radially inward is intended to be in the direction towards the engine central longitudinal axis A.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method for assembling a plug assembly for plugging one or more ports of a gas turbine engine, the method comprising:

inserting a first arm into a sheath through-passage of a sheath, the first arm comprising a first longitudinal portion and a first projection portion, inserting the first projection portion through a first opening in a passageway portion of the sheath;

inserting a second arm into the sheath through-passage of the sheath, the second arm comprising a second longitudinal portion and a second projection portion;

inserting the second projection portion through a second opening in the passageway portion of the sheath;

inserting a separating mechanism into the sheath through-passage between the first arm and the second arm;

installing a biasing mechanism;

sliding a top housing over the biasing mechanism such that the biasing mechanism is located in a cavity defined within the top housing, the biasing mechanism being configured to apply a force to the first arm and the second arm when the biasing mechanism is located in the cavity; and securing the top housing together with the sheath.

2. The method of claim 1, further comprising:

securing a slider seal housing onto a radially outward surface of an inner casing of the gas turbine engine;

inserting a slider seal into the slider seal housing, the slider seal housing including a slider seal seat configured to fit the slider seal therein; and securing a slider seal cover to the slider seal housing, the slider seal cover being configured to secure the slider seal in the slider seal housing.

3. The method of claim 2, wherein the inner casing further comprises an inner port, wherein the slider seal housing further comprises a slider seal housing through-passage aligned with the inner port, wherein the slider seal further comprises a seal through-passage aligned with the inner port, wherein the slider seal cover further comprises a cover through-passage aligned with the inner port, and wherein the method further comprises:

inserting an inner end of the sheath through the cover through-passage, the seal through-passage, and the slider seal housing through-passage; and inserting the inner end of the sheath into the inner port of the inner casing of the gas turbine engine.

4. The method of claim 1, further comprising:

inserting an inner end of the sheath into an inner port of an inner casing of the gas turbine engine.

5. The method of claim 1, further comprising:

securing the plug assembly to the gas turbine engine.

6. The method of claim 5, wherein the plug assembly is secured to an outer casing of the gas turbine engine.

7. The method of claim 6, wherein securing the plug assembly to the gas turbine engine further comprises:

aligning a housing through-passage within the top housing and a flange through-passage within a flange portion of the sheath with a threaded hole in the outer casing or in a component attached to the outer casing;

inserting a fastening mechanism through the housing through-passage and through the flange through-passage; and rotating the fastening mechanism such that a threaded portion of the fastening mechanism interlocks with the threaded hole to secure the plug assembly to the gas turbine engine.

8. The method of claim 1, wherein the separating mechanism is a separator body, the separator body comprising:

a lower end;

an upper end located opposite the lower end; and a separator body flange located between the lower end and the upper end, the separator body flange dividing the separator body into:

a lower portion located at or proximate the lower end; and an upper portion located at or proximate the upper end.

9. The method of claim 8, wherein the lower end is pointed or wedge shaped.

10. The method of claim 8, wherein installing the biasing mechanism further comprises sliding the biasing mechanism onto the upper portion of the separator body.

11. The method of claim 8, further comprising:

placing a c-seal on the first arm and the second arm.

12. The method of claim 1, wherein the separating mechanism is a spring.

13. The method of claim 1, wherein the biasing mechanism is a spring.

14. The method of claim 1, wherein the separating mechanism is a wedge shaped body, and wherein the first longitudinal portion and the second longitudinal portion have a wedge shape.

15. The method of claim 1, wherein the separating mechanism is a connector arm connecting the first arm to the second arm.

16. A plug assembly for plugging one or more ports of a gas turbine engine, the plug assembly comprising:

a sheath comprising:

an inner end;

an outer end located opposite the inner end;

a passageway portion located at or proximate the inner end;

a sheath through-passage extending from the outer end to a sheath through-passage base proximate the inner end;

a first opening in the passageway portion; and a second opening in the passageway portion;

a first arm comprising:

a first longitudinal portion located in the sheath through-passage; and a first projection portion projecting through the first opening;

a second arm comprising:

a second longitudinal portion located in the sheath through-passage; and a second projection portion projecting through the second opening;

a separating mechanism located in the sheath through-passage between the first arm and the second arm, the separating mechanism configured to separate the first arm from the second arm; and a biasing mechanism configured to apply a force to the first arm and the second arm, the force being parallel to the first longitudinal portion and the second longitudinal portion; and a top housing abutting the outer end of the sheath, the top housing comprising a cavity formed therein, wherein the biasing mechanism is located in the cavity.

17. The plug assembly of claim 16, wherein the separating mechanism is a separator body, the separator body comprising:

a lower end;

an upper end located opposite the lower end; and a separator body flange located between the lower end and the upper end, the separator body flange dividing the separator body into:

a lower portion located at or proximate the lower end; and an upper portion located at or proximate the upper end.

18. The plug assembly of claim 17, wherein the lower end is pointed or wedge shaped to help drive the first arm and the second arm apart.

19. The plug assembly of claim 17, wherein the biasing mechanism is located on the upper portion of the separator body.

20. The plug assembly of claim 16, wherein the separating mechanism is a spring.

* * * * *